US006464037B2

(12) United States Patent
Baldas et al.

(10) Patent No.: US 6,464,037 B2
(45) Date of Patent: Oct. 15, 2002

(54) RECONFIGURABLE WORK PLATFORM FOR AERIAL WORK PLATFORM SYSTEM, AERIAL WORK PLATFORM SYSTEM USING SAME, AND METHOD FOR RECONFIGURING A WORK PLATFORM

(75) Inventors: Jean-Luc Baldas, St Etienne de Fougéres; Jean-Claude Albert, St Medard en Jalles, both of (FR)

(73) Assignee: Delta Manlift S.A.S., Tonneins (FR)

( * ) Notice: Subject to any disclaimer, the term of this patent is extended or adjusted under 35 U.S.C. 154(b) by 0 days.

(21) Appl. No.: 09/736,224

(22) Filed: Dec. 15, 2000

(65) Prior Publication Data

US 2002/0074186 A1 Jun. 20, 2002

(51) Int. Cl.[7] ..... E04C 1/00

(52) U.S. Cl. ..... 182/69.6; 182/2.1; 182/141; 182/152; 414/22.51

(58) Field of Search ..... 182/69.6, 2.1, 182/2.7, 63, 127, 145, 82

(56) References Cited

U.S. PATENT DOCUMENTS

| | | | | | |
|---|---|---|---|---|---|
| 4,171,033 | A | * | 10/1979 | Rust et al. | 182/69.6 |
| 4,280,243 | A | * | 7/1981 | Durrant | 14/71.1 |
| 4,492,501 | A | * | 1/1985 | Haney | 414/22 |
| 5,135,074 | A | * | 8/1992 | Hornagold | 182/2 |
| 5,249,642 | A | * | 10/1993 | Kishi | 182/63.1 X |
| 5,725,205 | A | * | 3/1998 | O'Berg | 269/37 |
| 6,138,812 | A | * | 10/2000 | Kimener | 193/356 |
| 6,145,619 | A | * | 11/2000 | Risser | 182/2.1 X |
| 6,152,264 | A | * | 11/2000 | Gaines, Sr. et al. | 182/2.1 X |

* cited by examiner

*Primary Examiner*—Bruce A. Lev
(74) *Attorney, Agent, or Firm*—Birch, Stewart, Kolasch & Birch, LLP

(57) ABSTRACT

A reconfigurable work platform for an aerial work platform system includes at least one outwardly tiltable portion on which an occupant of the work platform can lean so as to extend his or her lateral reach. This is useful when the work platform itself cannot be moved closer to a desired location. An aerial work platform system using such a reconfigurable work platform, and a method for reconfiguring a work platform are also contemplated.

34 Claims, 4 Drawing Sheets

RECONFIGURABLE WORK PLATFORM FOR AERIAL WORK PLATFORM SYSTEM, AERIAL WORK PLATFORM SYSTEM USING SAME, AND METHOD FOR RECONFIGURING A WORK PLATFORM

FIELD OF THE INVENTION

The present invention relates to reconfigurable work platforms for use with aerial work platform systems that have a workspace therein for an occupant, and a method for reconfiguring such work platforms.

BACKGROUND OF THE INVENTION

Generally, aerial work platform systems that provide a selectively elevated work position are conventionally known. Such systems use a variety of arrangements to selectively elevate a work platform into an elevated position from which one or more workers can work. These arrangements include, for example, vertical lift, articulated and non-articulated boom, and scissors-lift systems.

However, merely elevating a worker into position is sometimes not sufficient to facilitate working. In some environments, such as aircraft landing gear wells, a conventional aerial work platform system may not have sufficient lateral or horizontal freedom of movement to position a worker where needed. Therefore, the conventional system may be able to raise a worker to a required height, but may not be able to position the worker properly in the horizontal dimension, such that the working position is out of the worker's reach.

SUMMARY OF THE INVENTION

In view of the foregoing, the present invention is generally directed to a reconfigurable work platform for an aerial work platform system that permits a worker to extend his or her reach in a horizontal dimension. The present invention is also directed to aerial work platform systems including such reconfigurable work platforms, as well as a method for reconfiguring such reconfigurable work platforms.

A reconfigurable work platform according to the present invention has a workspace defined therein, and includes a platform floor on which one or more occupants stand, and a guard barrier, wall, or other occupant retaining structure provided about at least a portion of a periphery of the workspace. The guard barrier, wall, or other retaining structure includes at least one outwardly tiltable portion. The outwardly tiltable portion provides a surface on which an occupant can lean outwardly to extend his or her lateral reach.

The present invention is also directed to an aerial work platform system that uses such a reconfigurable work platform. Such an aerial work platform system may use, for example, any conventional mechanism for elevating the work platform. In addition, an aerial work platform system according to the present invention may be mobile, and furthermore, may be self-propelled in a known manner.

Finally, the present invention is also directed to a method for reconfiguring the work platform mentioned above.

BRIEF DESCRIPTION OF THE DRAWINGS

The present invention, as discussed above, will be described in detail hereinbelow with reference to the appended drawings, in which.

It is to be understood that the drawings appended hereto are solely for the purpose of illustration and that dimensions, relative positions, and the like, may not be to scale.

DETAILED DESCRIPTION OF THE INVENTION

Figure 1:
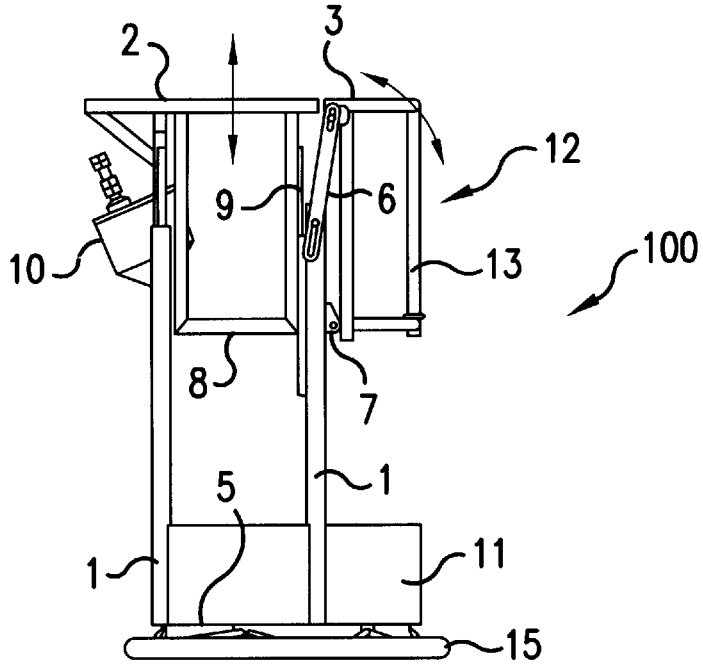
FIG. 1 is a side view of a work platform according to the present invention having a tiltable portion in an upright position.

FIG. 1 is a side view of a work platform 100 according to a first embodiment of the present invention. Most generally, work platform 100 includes a platform floor 5 upon which one or more occupants of the work platform 100 stand, and a guard barrier provided around at least part of a periphery of a workspace for the one or more occupants.

The guard barrier according to the present invention may take a variety of forms. For example, as illustrated, the guard barrier generally includes a combination of one or more vertical rails 1, a top rail 2, one or more intermediate rails 8 (only one intermediate rail being shown in the side views of the work platform), and a lower guard wall (or toeboard) 11 formed at a lower periphery of the workspace.

It is important to note that, as mentioned, the guard barrier can have other configurations, such as, without limitation, solid or perforated walls extending upwardly from the platform floor 5, or a network of bars or rails in configurations other than that illustrated. Generally, the material(s) from which the guard barrier is/are made should be lightweight but strong and durable. Such materials may include, without limitation, metal (such as aluminum, steel, and related alloys), fiberglass, plastic, carbon fiber, and wood.

The guard barrier also includes at least one outwardly tiltable portion 12. As illustrated in FIGS. 1 and 2 and FIGS. 3 and 4, tiltable portion 12 is constructed so as to be outwardly tiltable so as to define a surface or resting member on which an occupant of the work platform can lean, so as to be able to extend his or her lateral reach relative to the position of the work platform. The manner in which an occupant stands on work platform 100 and/or leans on tiltable portion 12 can be clearly seen in, for example, FIGS. 5*a*, 5*b*, 6*a*, and 6*b*.

Figure 3:
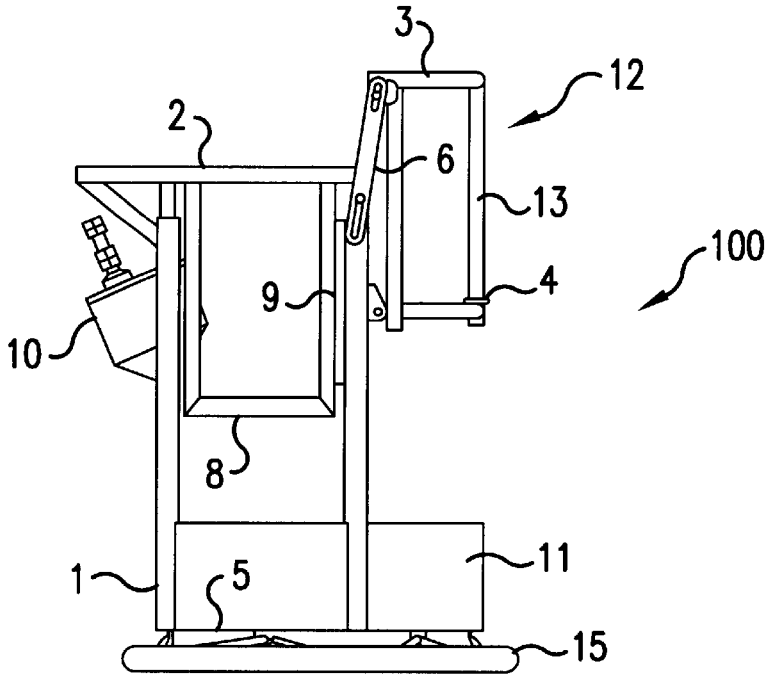
FIG. 3 is a side view of a work platform having a vertically retracted guard barrier portion and a tiltable portion in an upright position.

As illustrated, tiltable portion 12 is made up of a plurality of rails, including a secondary top rail 3, and one or more secondary intermediate rails 13. When tiltable portion 12 is in its upright position (as seen in FIGS. 1 and 3, for example), top rail 2 and secondary top rail 3 together surround at least part of the periphery of the workspace defined in work platform 100.

Figure 2:
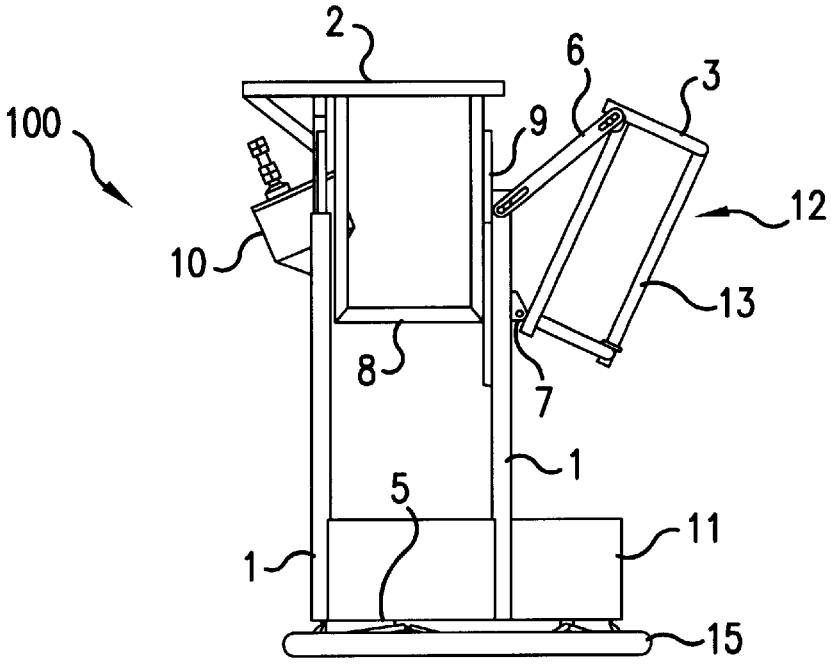
FIG. 2 is a side view of the work platform seen in FIG. 1 with the tiltable portion tilted outwardly.

FIG. 2 illustrates the manner in which tiltable portion 12 is outwardly tiltable. Tiltable portion 12 is, for example, pivotable about a hinge 7. A link 6 is connected between a top edge of tiltable portion 12 and an intermediate portion of a vertical rail 1. Link 6 may be provided with slots as shown to accommodate relative movement of tiltable portion 12 relative to the intermediate portion of the vertical rail 1.

In general, tiltable portion 12 may be arranged so as to tend to tilt outwardly. Therefore, when tiltable portion 12 is tilted outwardly, it simply rests against link 6, which prevents overrotation of tiltable portion 12. In this case, it is preferable to provide a locking mechanism, including any known locking mechanism such as manual latches, hooks and eyes, etc. to retain the tiltable portion 12 in the vertical position when it is so positioned.

In one variation of the present invention, tiltable portion 12 may be tiltable to one of a plurality of tilted positions. This can be accomplished by, for example, providing the slot in link 6 associated with the intermediate portion of vertical rail 1 with a plurality of suitably placed notches along the length thereof, so that a pin or the like provided on vertical rail 1 can catch on a respective notch so as to hold the tiltable portion 12 in a given tilted position.

Conversely, tiltable portion 12 may be biased so as to remain vertical by, for example, a spring force. Therefore, notches (oriented oppositely from the example immediately hereinabove) can be provided along the slot in link 6 associated with the intermediate portion of vertical rail 1, so that a pin or the like provided on the vertical rail can catch on a respective notch to maintain the tiltable portion in a given tilted position.

In one example of the present invention, tiltable portion 12 can be moved into a tilted position completely by hand either without using tools, or using only hand tools and the like. In another example of the present invention, the movement of tiltable portion 12 can be motorized in a known manner, such as using a motor and gearing to move the tiltable portion 12.

The work platform 100 includes an entranceway in a side thereof. The entranceway may simply be a gap or opening in the guard barrier (not shown), or a hinged door or gate (not shown) may be provided in a known manner.

A control box 10 for controlling an aerial work platform system on which the work platform 100 is mounted (e.g., controlling elevation of the work platform) may be mounted as shown in FIGS. 1–4. In the alternative, the control box 10 may be mounted on tiltable portion 12 (not shown) in a similar manner to that illustrated in FIGS. 1 and 2.

A mounting structure for mounting work platform 100 on an aerial work platform system is not shown in FIGS. 1 and 2 (or FIGS. 3 and 4) for clarity. An example of a mounting structure can instead be seen in FIGS. 5*a*, 5*b*, 6*a*, and 6*b*.

Although the appended drawings illustrate only one tiltable portion 12, more than one tiltable portion 12 may be provided in accordance with the foregoing description. For example, tiltable portions may be provided on different sides of the guard barrier so as to permit an occupant to extend his or her reach even further in several lateral directions.

Figure 4:
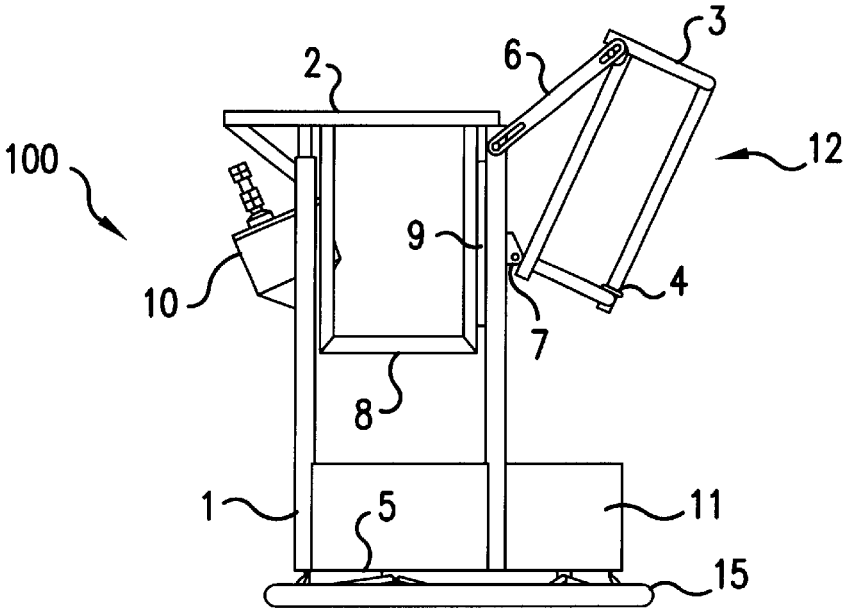
FIG. 4 is a side view of the work platform seen in FIG. 3 with the tiltable portion tilted outwardly.

Occupants of the work platform 100 can be afforded additional freedom of lateral movement by permitting top rail 2 to be vertically lowered relative to vertical rails 1, as seen in FIGS. 3 and 4 (compared to FIGS. 1 and 2). Top rail 2 may, for example, be telescopingly mounted, via structure 9, relative to vertical rails 1. Other than lowering top rail 2, FIGS. 3 and 4 are substantially identical to FIGS. 1 and 2, respectively, so a detailed explanation will not be repeated.

Occupant restraints and the like may be provided in a known manner to help restrain occupants within the workspace of work platform 100.

Figure 5A:
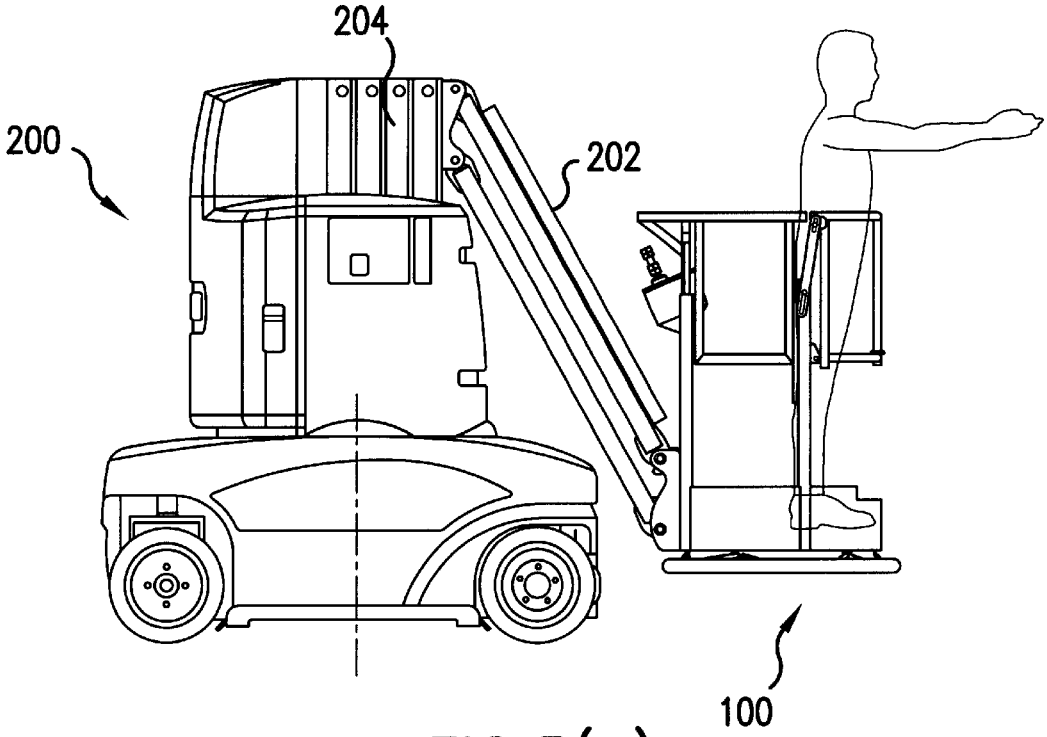
FIG. 5*a* is a side view of an aerial work platform having the work platform illustrated in FIG. 1 mounted thereon.
Figure 5B:
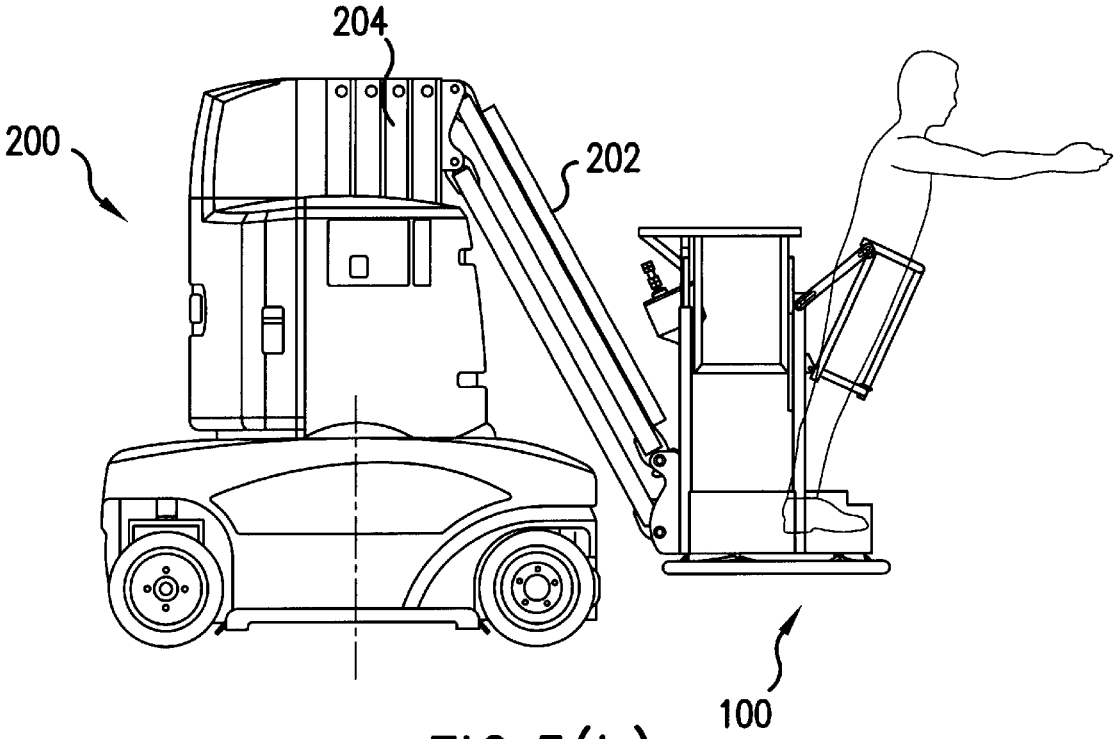
FIG. 5*b* is a side view of the aerial work platform of FIG. 5*a* having the work platform illustrated in FIG. 2 mounted thereon.
Figure 6A:
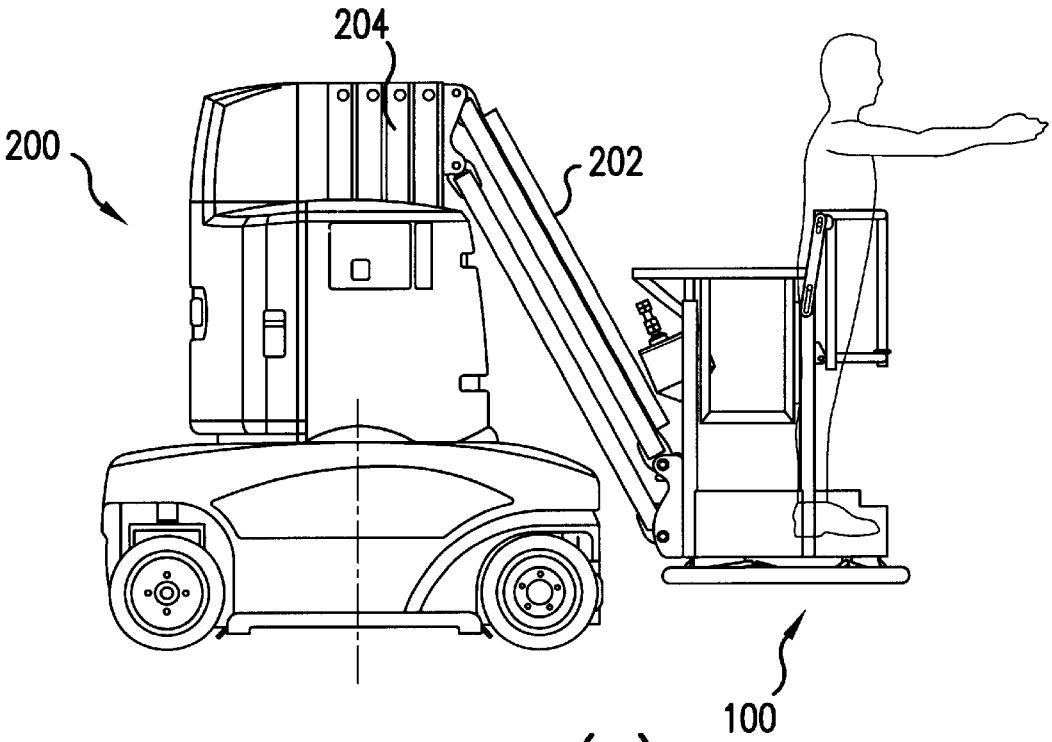
FIG. 6*a* is a side view of an aerial work platform having the work platform illustrated in FIG. 3 mounted thereon.
Figure 6B:
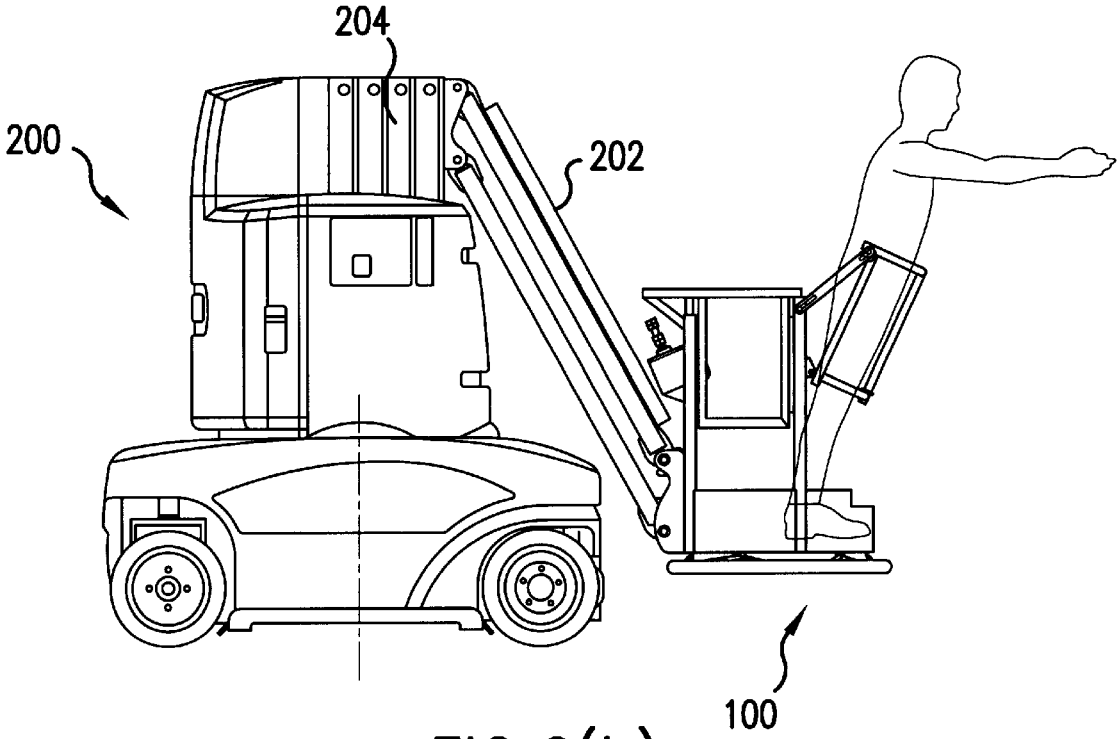
FIG. 6*b* is a side view of the aerial work platform of FIG. 6*a* having the work platform illustrated in FIG. 4 mounted thereon.

FIGS. 5*a* and 5*b* generally correspond to the work platform illustrated in FIGS. 1 and 2 (i.e., with top rail 2 raised), respectively, and FIGS. 6*a* and 6*b* generally correspond to the work platform illustrated in FIGS. 3 and 4 (i.e., with top rail 2 lowered), respectively.

FIGS. 5*a*, 5*b*, 6*a*, 6*b* illustrate a work platform according to the present invention mounted as part of an aerial work platform system. In this case, solely by way of example, a conventional vertical lift aerial work platform system 200 is illustrated, including an boom member 202 connected to a vertical lift mechanism 204. The articulated boom 202 could be omitted, such that work platform 100 is directed mounted on the vertical lift mechanism 204.

As mentioned above, other aerial work platform systems can be used with the work platform 100 as well, including without limitation, an articulated boom system, a non-articulated boom system, and a scissors-lift system. In each case, the work platform 100 is used instead of conventional work platforms.

As is known in the art, aerial work platform system 200 may be mobile, or even self-propelled. Such operation (including, for example, steering) can be controlled by control box 10.

Aerial work platform system 200 may be provided with a conventional stop mechanism to stop motion of work platform 100 when work platform 100 approaches or contacts another structure. Such a stop mechanism may be, for example and without limitation, an ultrasonic transceiver, a contact sensor, an infrared transceiver, a radar unit, etc. In the example of the present invention illustrated, one or more portions of the work platform 100 (see, for example, reference numeral 15) may be coupled to one or more switches that act to stop motion of the work platform 100 when the one or more portions 15 contact a surface.

The present invention being thusly described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A work platform for use with an elevating aerial work platform system, the work platform having a workspace therein for one or more occupants and comprising:

a platform floor; and a guard barrier provided about at least a portion of a periphery of the workspace, said guard barrier including at least one portion having at least three sides, which is outwardly tiltable away from the workspace, about a pivot axis substantially parallel to the platform floor, from a substantially upright position to a tilted position, wherein an occupant can fit within the at least three sides of the at least. one portion to allow the occupant to lean against the guard barrier in its tilted position and have an extended reach.

2. The work platform as in claim 1, wherein said at least one tiltable portion is manually tiltable.

3. The work platform as in claim 1, wherein said at least one tiltable portion is tiltable to a plurality of tilted positions.

4. The work platform as in claim 1, wherein said at least one tiltable portion comprises a plurality of coupled elongate portions.

5. The work platform as in claim 1, wherein said at least one tiltable portion comprises a single material portion.

6. The work platform as in claim 5, wherein said single material portion is made from at least one of metal, fiberglass, plastic, carbon fiber, and wood.

7. The work platform as in claim 1, wherein said at least one tiltable portion is fixable in a given position.

8. The work platform as in claim 1, wherein said guard barrier includes at least one entranceway into the workspace.

9. An elevating aerial work platform system comprising:

a base;

a work platform having a workspace therein for one or more occupants; and a mechanism for selectively elevating said work platform, wherein said work platform includes a platform floor and a guard barrier provided about at least a portion of a periphery of the workspace, said guard barrier including at least one portion having at least three sides, which is outwardly tiltable away from the workspace, about a pivot axis substantially parallel to the platform floor, from a substantially upright position to a tilted position, wherein an occupant can fit within the at least three sides of the at least one portion to allow the occupant to lean against the guard barrier in its tilted position and have an extended reach.

10. The aerial work platform system as in claim 9, wherein said mechanism for selectively elevating said work platform is a vertical lift mechanism.

11. The aerial work platform system as in claim 10, wherein said vertical lift mechanism comprises a boom member.

12. The aerial work platform system as in claim 9, wherein said mechanism for selectively elevating said work platform is a scissors-lift mechanism.

13. The aerial work platform system as in claim 9, wherein said mechanism for selectively elevating said work platform is one of an articulated boom mechanism and a non-articulated boom mechanism.

14. The aerial work platform system as in claim 9, wherein said base is mobile.

15. The aerial work platform system as in claim 14, wherein said base is self-propelled.

16. The aerial work platform system as in claim 15, therein said work platform includes a steering control for controlling motion of said self-propelled base.

17. The aerial work platform system as in claim 16, wherein said steering control is provided on said at least one tiltable portion.

18. The aerial work platform system as in claim 9, wherein said work platform includes a control for controlling said mechanism for selectively elevating said work platform.

19. The aerial work platform system as in claim 18, wherein said control for controlling said mechanism for selectively elevating said work platform is provided on said at least one tiltable portion.

20. The aerial work platform system as in claim 9, comprising a stop mechanism for stopping motion of said work platform when said work platform comes within a threshold distance of another structure.

21. The aerial work platform system as in claim 9, wherein said at least one tiltable portion is manually tiltable.

22. The aerial work platform system as in claim 9, wherein said at least one tiltable platform is tiltable to a plurality of tilted positions.

23. The aerial work platform system as in claim 9, wherein said guard barrier includes a plurality of outwardly tiltable portions.

24. The aerial work platform system as in claim 9, wherein said at least one tiltable portion comprises a plurality of coupled elongate portions.

25. The aerial work platform system as in claim 9, wherein said at least one tiltable portion comprises a single material portion.

26. The aerial work platform system as in claim 25, wherein said single material portion is made from at least one of metal, fiberglass, carbon fiber, wood, and plastic.

27. The aerial work platform system as in claim 9, wherein said at least one tiltable portion is fixable in a given position.

28. The aerial work platform system as in claim 9, wherein said work platform includes an entranceway into the workspace.

29. In a work platform for use with an elevating aerial work platform system, a method of reconfiguring a workspace in the work platform comprising tilting a portion of a guard barrier provided around at least a part of a periphery of the workspace between a first position and a second position, wherein the portion has at least three sides and the first position is substantially upright and the second position is titled outward away from the workspace, about a pivot axis substantially parallel to the platform floor, and wherein an occupant can fit within the at least three sides of the portion to allow the occupant to lean against the guard barrier in its tilted position and have an extended reach.

30. The method of claim 29, comprising changing a height of a portion of the guard barrier other than the tilted portion of the guard barrier.

31. The method of claim 29, wherein tilting a portion of a guard barrier between a first position and a second position comprises tilting a portion of a guard barrier between a first position and one of a plurality of second positions.

32. The method of claim 29, wherein the second position is an outwardly tilted position.

33. The method claim 32, wherein tilting a portion of a guard barrier between a first position and a second position includes providing a rest surface against which an occupant of the work platform can lean.

34. The aerial work platform system as in claim 9, comprising a stop mechanism for stopping motion of said work platform when said work platform contacts another structure.

* * * * *